US008641837B2

(12) United States Patent
Aruga et al.

(10) Patent No.: US 8,641,837 B2
(45) Date of Patent: Feb. 4, 2014

(54) COPPER ALLOY HAVING EXCELLENT STRESS RELAXATION PROPERTY

(75) Inventors: Yasuhiro Aruga, Kobe (JP); Katsura Kajihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 1308 days.

(21) Appl. No.: 11/469,648

(22) Filed: Sep. 1, 2006

(65) Prior Publication Data

US 2007/0148032 A1 Jun. 28, 2007

(30) Foreign Application Priority Data

Dec. 22, 2005 (JP) ..... 2005-370486

(51) Int. Cl.
*C22C 9/06* (2006.01)

(52) U.S. Cl.
USPC ..... 148/433; 420/472

(58) Field of Classification Search
USPC ..... 420/472; 148/433
See application file for complete search history.

(56) References Cited

U.S. PATENT DOCUMENTS

| | | | |
|---|---|---|---|
| 5,322,575 | A | 6/1994 | Endo et al. |
| 6,132,529 | A | 10/2000 | Hatakeyama et al. |
| 2011/0182767 | A1 | 7/2011 | Aruga et al. |

FOREIGN PATENT DOCUMENTS

| | | | |
|---|---|---|---|
| EP | 0 859 065 A1 | | 8/1998 |
| EP | 1 612 285 A1 | | 1/2006 |
| JP | 4-154942 | | 5/1992 |
| JP | 4236736 | * | 8/1992 |
| JP | 10-226835 | | 8/1998 |
| JP | 11-293367 | | 10/1999 |
| JP | 2000-129377 | | 5/2000 |
| JP | 2000-256814 | | 9/2000 |
| JP | 2000256814 | * | 9/2000 |
| JP | 2001-262297 | | 9/2001 |
| JP | 2002-294368 | | 10/2002 |
| WO | WO 2006/132317 A1 | | 12/2006 |

OTHER PUBLICATIONS

U.S. Appl. No. 11/916,730, filed Dec. 6, 2007, Aruga, et al.
U.S. Appl. No. 11/994,136, filed Dec. 28, 2007, Aruga, et al.
U.S. Appl. No. 12/297,069, filed Oct. 14, 2008, Aruga, et al.
U.S. Appl. No. 12/374,154, filed Jan. 16, 2009, Aruga, et al.
U.S. Appl. No. 12/441,904, filed Mar. 19, 2009, Aruga, et al.
U.S. Appl. No. 12/672,092, filed Feb. 4, 2010, Aruga, et al.
U.S. Appl. No. 12/811,339, filed Jun. 30, 2010, Aruga.

* cited by examiner

*Primary Examiner* — Sikyin Ip
(74) *Attorney, Agent, or Firm* — Oblon, Spivak, McClelland, Maier & Neustadt, L.L.P.

(57) ABSTRACT

A Cu—Ni—Sn—P alloy is provided, which is excellent in stress relaxation property in a direction perpendicular to a rolling direction, and has any of high strength, high conductivity, and excellent bendability. A copper alloy contains 0.1 to 3.0% of Ni, 0.1 to 3.0% of Sn, and 0.01 to 0.3% of P in mass percent respectively, and includes copper and inevitable impurities as the remainder; wherein in a radial distribution function around a Ni atom according to a XAFS analysis method, a first peak position is within a range of 2.16 to 2.35 Å, the position indicating a distance between a Ni atom in Cu and an atom nearest to the Ni atom. Thus, distances to atoms around the Ni atom in Cu are comparatively increased, so that the stress relaxation property in a direction perpendicular to the rolling direction of the copper alloy is improved.

18 Claims, 3 Drawing Sheets

COPPER ALLOY HAVING EXCELLENT STRESS RELAXATION PROPERTY

BACKGROUND OF THE INVENTION

1. Field of the Invention

The present invention relates to a copper alloy having an excellent stress relaxation property, and particularly relates to a copper alloy having a suitable stress relaxation property for connection parts such as automotive terminals and connectors.

2. Description of Related Art

The connection parts such as automotive terminals and connectors are now required to have a performance of ensuring reliability in high-temperature such as in an engine room. One of the most important properties for the reliability in high-temperature is a property of maintaining fitting force of a contact, so-called, stress relaxation property. That is, in the case that stationary displacement is given to a spring-like part comprising a copper alloy, for example, in the case that a tab of a male terminal is fitted in a female terminal by a spring-like contact of the female terminal, when the connection parts are kept in high-temperature such as in an engine room, the parts gradually lose fitting force of the contact with time. The stress relaxation property means a resistance property against such cases.

As copper alloys having excellent stress relaxation property, alloys of a Cu—Ni—Si alloy, a Cu—Ti alloy, and a Cu—Be alloy have been widely known. Since any one of them contains a strong oxidizing element (Si, Ti, Be or the like), they cannot be melted and ingot casted in the air, and consequently, increase in cost is inevitable due to waning productivity.

On the contrary, in a Cu—Ni—Sn—P alloy having a comparatively small amount of additive elements, so-called ingot casting using a shaft-furnace can be carried out, so that large reduction in cost can be achieved due to high productivity. Again in the Cu—Ni—Sn—P alloy, measures of improving the stress relaxation property have been variously proposed.

For example, the following patent literature 1 discloses a method of manufacturing a copper alloy for connector having an excellent stress relaxation property. The manufacturing method is for the Cu—Ni—Sn—P alloy, wherein Ni—P intermetallic compounds are dispersed in a matrix uniformly and finely, so that electric conductivity is improved, and in addition, the stress relaxation property and the like are improved. According to the literature, to obtain desired properties, temperatures at start and finish of cooling in hot rolling, and a rate of the cooling, and furthermore temperatures and time of heat treatment for 5 to 720 min performed during a subsequent cold rolling step are necessary to be strictly controlled.

As a Cu—Ni—Sn—P alloy having stress relaxation property and a method of manufacturing the alloy, the following patent literatures 2 and 3 disclose a Cu—Ni—Sn—P alloy formed as a solid-solution type copper alloy in which precipitation of Ni—P compounds is controlled by decreasing a P content to the utmost. According to this, an advantage is given, that is, the alloy can be manufactured by heat treatment of annealing in an extremely short time without needing a sophisticated heat treatment technique. For example, in the patent literature 3, stabilizing annealing after final cold rolling is performed for 5 sec to 1 min within a temperature range of 250 to 850° C. in a continuous annealing furnace, and each of a heating rate and a cooling rate in the annealing is set to be at least 10° C./sec, thereby the stress relaxation property is improved.

[Patent Literature 1]
Japanese Patent No. 2,844,120
[Patent Literature 2]
Japanese Patent Laid-Open No. H11-293367
[Patent Literature 3]
Japanese Patent Laid-Open No. 2002-294368

SUMMARY OF THE INVENTION

Regarding the stress relaxation property, the standard of Society of Automotive Engineers of Japan, JASO-C400 specifies a stress relaxation ratio after holding at 150° C. for 1000 hr to be 15% or less. FIGS. 3A to 3B show test equipment of the stress relaxation property. Using the test equipment, a test piece 1 cut in a reed shape is fixed to a rigid test stage 2 at one end, and raised at the other end in a cantilever manner to be warped (size of warp d), then held at predetermined temperature for a predetermined time, then unloaded at room temperature, and a magnitude of warp after unloading (permanent strain) is obtained as δ. The stress relaxation ratio (RS) is expressed by $RS=(\delta/d)\times 100$.

The stress relaxation ratio of a copper alloy sheet has anisotropy, and therefore the ratio has a different value depending on orientation of a longitudinal direction of the test piece with respect to a rolling direction of the copper alloy sheet. Generally, the stress relaxation ratio is small in a direction parallel to the rolling direction compared with a perpendicular direction. However, the JASO standard does not specify such a direction, therefore it has been regarded to be acceptable that the stress relaxation ratio of 15% or less is achieved in one of the parallel and perpendicular directions to the rolling direction. However, in recent years, it is regarded to be desirable that the copper alloy sheet has an excellent stress relaxation property in the perpendicular direction to the rolling direction of the sheet.

FIG. 4A shows a side structure of a typical box-like connector (female terminal 3), and FIG. 4B shows a sectional structure of the connector. In FIG. 4B, a pressing strip 5 is supported in a cantilevered manner by an upper holder portion 4, and when a male terminal 6 is inserted into the connector, the pressing strip 5 is elastically deformed, and the male terminal 6 is fixed by reaction force of such deformation. In FIG. 4B, reference numeral 7 is a wire connection portion, and 8 is a tongue strip for fixing. Here, when the female terminal 3 is manufactured by pressing the copper alloy sheet, sheet layout is made such that a longitudinal direction of the female terminal 3 (longitudinal direction of the pressing strip 5) is oriented in a direction perpendicular to a rolling direction. The pressing strip 5 is required to have an excellent stress relaxation property particularly for bending in the longitudinal direction of the pressing strip 5 (elastic deformation). Therefore, the copper alloy sheet is required to have the excellent stress relaxation property in the direction perpendicular to the rolling direction.

On the contrary, in the solid-solution type copper alloy disclosed in the patent literatures 2 and 3, while the excellent stress relaxation property having the stress relaxation ratio of 15% or less has been achieved substantially in the parallel direction to the rolling direction, it has not been achieved yet in the perpendicular direction.

In recent years, it is required of such a solid-solution type copper alloy even from a user side that the stress relaxation property is excellent in the perpendicular direction to the rolling direction compared with the parallel direction.

It is desirable to achieve the excellent stress relaxation property having the stress relaxation ratio of 15% or less in the direction perpendicular to the rolling direction in the Cu—Ni—Sn—P alloy.

A copper alloy having excellent stress relaxation property of an embodiment of the invention is summarized in that the copper alloy contains 0.1 to 3.0% of Ni, 0.1 to 3.0% of Sn, and 0.01 to 0.3% of P in mass percent respectively, and includes copper and inevitable impurities as the remainder, wherein in a radial distribution function around a Ni atom according to a XAFS analysis method, a first peak position is within a range of 2.16 to 2.35 Å, the position indicating a distance between a Ni atom in Cu and an atom nearest to the Ni atom.

Preferably in the copper alloy of the embodiment of the invention, a composition as above further contains 0.5% or less of Fe, 1% or less of Zn, 0.1% or less of Mn, 0.1% or less of Si, and 0.3% or less of Mg in mass percent. Furthermore, in the above and this composition, a total content of elements of Ca, Zr, Ag, Cr, Cd, Be, Ti, Co, Au and Pt are preferably 1.0% or less in mass percent. Still furthermore, in the above and these compositions, a total content of elements of Hf, Th, Li, Na, K, Sr, Pd, W, S, C, Nb, Al, V, Y, Mo, Pb, In, Ga, Ge, As, Sb, Bi, Te, B and mish metals is preferably 0.1% or less in mass percent.

Advantage of the Invention

According to the embodiment of the invention, in the Cu—Ni—Sn—P alloys, the excellent stress relaxation property having the stress relaxation ratio of 15% or less can be achieved in the direction perpendicular to the rolling direction. Moreover, a copper alloy having excellent properties for terminals and connectors can be obtained, including an excellent bending property, and high conductivity (about 30% IACS or more), and high strength (yield strength of about 480 MPa or more).

In the solid-solution type copper alloy in the related art in which precipitation of the Ni—P compounds is controlled, while the excellent stress relaxation property having the stress relaxation ratio of 15% or less has been achieved substantially in the parallel direction to the rolling direction, it has not been achieved yet in the perpendicular direction. The inventors investigated the reason why.

As a result, the inventors found that when coarse oxides, crystallized substances, and precipitates of Ni having a certain size or more were controlled, the excellent stress relaxation property having the stress relaxation ratio of 15% or less was achieved in the direction perpendicular to the rolling direction, and have already applied for a patent as Japanese Patent Laid-Open No. 2005-270694.

After the inventors continuously conducted investigation, as a result, they found that a Ni atom in Cu and a distance (atomic distance) between an atom such as a Cu atom around the Ni atom significantly affected on the stress relaxation property, in addition to such control of the oxides, crystallized substances and precipitates of Ni. That is, when the distance to the atom such as the Cu atom around the Ni atom is within the specified range, an excellent stress relaxation property is obtained.

Typical structure observation approaches such as SEM and TEM, including an X-ray diffraction method, cannot directly measure the distance between the Ni atom in Cu and the atom such as the Cu atom around the Ni atom (hereinafter, referred to as a atomic distance to Ni atom). That is, the Ni atom in Cu mentioned in the embodiment of the invention means a Ni atom as atomic arrangement rather than Ni dissolved or precipitated in Cu in a typical metallurgical expression, as described later.

On the contrary, according to the XAFS (X-ray Absorption Fine Structure) analysis method, the atomic distance to Ni atom in a structure of the Cu—Ni—Sn—P alloy can be measured. Detail of a measurement method of XAFS is described later.

An embodiment of the invention selects a first peak position (the atomic distance between a Ni atom and an atom nearest to the Ni atom) in the radial distribution function around the Ni atom as the atomic distance to Ni atom according to the XAFS analysis method, and specifies the first peak position to be within a range of 2.16 to 2.35 Å. The first peak is a function (waveform) commonly showing a maximum peak in the radial distribution function around the Ni atom, as described later. The first peak position is a position of a peak (top) in the first peak, which shows the atomic distance between the Ni atom and the nearest atom.

Thus, in the embodiment of the invention, the excellent stress relaxation property of the Cu—Ni—Sn—P alloy is achieved in the direction perpendicular to the rolling direction. In addition, an excellent bending property, high conductivity, and high strength can be obtained.

BRIEF DESCRIPTION OF THE DRAWINGS

FIGS. 4A to 4B show a structure of a box-like connector, wherein FIG. 4A is a side view, and FIG. 4B is a cross sectional view.

DESCRIPTION OF THE PREFERRED EMBODIMENT (Condition of Ni Atoms)

Figure 2:
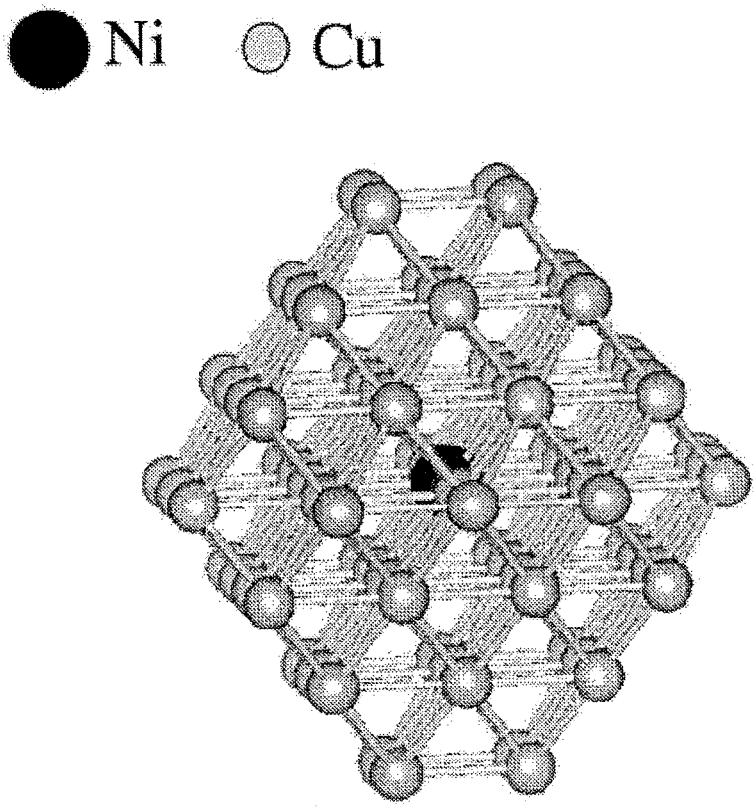
FIG. 2 is a schematic view showing an atomic arrangement condition assuming that only one Ni atom exists in copper.

FIG. 2 schematically shows an atomic arrangement condition in the case where only one Ni atom is assumed to exist in Cu in a manner of being substituted for a Cu atom. In FIG. 2, a particle shown by a comparatively large black circle in the center is the Ni atom in Cu, which is surrounded by a number of Cu atoms shown by comparatively small white circles around the Ni atom.

The embodiment of the invention comparatively increases distances between the Ni atom in Cu and atoms such as the Cu atoms around the Ni atoms, so that the stress relaxation property of the Cu—Ni—Sn—P alloy is improved.

In the actual Cu—Ni—Sn—P alloy, atoms around the Ni atom are not limited to the Cu atoms, and atoms of elements such as Ni, Sn and P, which were added to the alloy, may exist around it. The Ni atom in Cu mentioned in the embodiment of the invention is Ni dissolved or precipitated in Cu in the typical metallurgical expression (rough expression). However, the embodiment of the invention concerns with the Ni atom as atomic arrangement, and the atomic distance to the atom nearest to the Ni atom. Therefore, the Ni atom in Cu mentioned in the embodiment of the invention is a Ni atom in a condition of being randomly bonded to Cu or atoms of elements added to the alloy, such as Ni, Sn and P (crystal structures are also varied).

In this regard, to improve the stress relaxation property, the embodiment of the invention controls an average distance of respective distances between one Ni atom and a plurality of atoms near the Ni atom as the distances between the Ni atom in Cu and the atoms around the Ni atom (atomic distances to Ni atom). However, the embodiment of the invention specifies the atomic distance to the Ni atom using a first peak position (in the radial distribution function around the Ni atom according to the XAFS analysis method) indicating an atomic distance to an atom nearest to the Ni atom among the atoms around the Ni atom.

That is, the embodiment of the invention measures distances to the atoms such as Cu around the Ni atom as the radial distribution function around the Ni atom according to the XAFS analysis method, and in the light of improving the stress relaxation property of the Cu—Ni—Sn—P alloy, specifies the first peak position to be within the range of 2.16 to 2.35 Å, the position indicating the atomic distance between the Ni atom and the nearest atom in the radial distribution function. Hereinafter, the XAFS analysis method itself, and a concrete measuring method for specifying and its meaning are concretely described.

(XAFS Analysis Method)

In the XAFS analysis method, an X-ray absorption spectrum of a measuring object is analyzed, thereby information on an atomic structure or a cluster is obtained. An example of obtaining atomic arrangement (radial distribution around an iron atom) of a rust layer which is very linked to weather resistance of a steel surface, is reported in Japanese Patent Laid-Open No. 2002-256463 ([0012] to [0023]). Furthermore, an example of structural analysis of Al—Nd around Nd in an Al—Nd alloy thin-film for a wiring material of a liquid crystal display panel is reported in "Analysis Technique of Local Structure of Electronic Material (6)", Inspection Technique, 2000.1., pp 36 to 39. Still furthermore, many kinds of XAFS measuring apparatus are disclosed in JP-A-2002-318208, JP-A-2001-21507, JP-A-2001-33403 and the like.

(Principle of XAFS Analysis Method)

A principle of structural analysis of a material by the XAFS analysis method is described below. When absorptance of a material is measured with photon energy of X-rays being increased, the absorptance is decreased with increase in photon energy of X-rays. However, particular photon energy of X-rays specific to the material (X-ray absorption edge) exists, wherein the absorptance is abruptly increased. In this case, photoelectrons caused by absorption of X-rays are partially reflected as structural information with respect to an absorption level of X-rays, due to scattering and interference by a plurality of atoms. Therefore, when an absorption level of X-rays of a material is monitored, information on a cluster in an atomic structure or a structure of the material is obtained.

Further specifically, when a substance is placed on a beam line of fluorescent X-rays, an absorption level of X-rays by the substance (X-ray absorption coefficient $\mu$) is calculated by $\mu t = \ln(I0/It)$ (where t is the thickness of a specimen) from intensity of X-rays irradiated to the substance (injected X-ray intensity: I0) and intensity of X-rays transmitted through the substance (fluorescent X-ray intensity: It).

Here, an X-ray absorption spectrum of Ni as a focused atom is measured while the X-ray photon energy (wavelength) injected to a copper alloy containing Ni as the above substance is changed, and increase and decrease of the X-ray absorption coefficient $\mu$ are monitored (scanned). Consequently, steep increase, where the X-ray absorption coefficient is maximized, is observed at particular X-ray photon energy (the absorption edge of Ni atom: K absorption edge of Ni). This is because when photon energy of injected X-rays is increased to have intensity corresponding to binding energy of inner shell electrons of Ni as the focused atom, photoelectrons are discharged, which have kinetic energy corresponding to difference between excitation energy of the injected X-rays and the binding energy of the inner shell electrons.

An energy position at the absorption edge is inherent in each element such as Ni. Therefore, if the structural information can be extracted in an energy region near the absorption edge, the information is inherent in the element.

(XANES of Ni)

A fine structure shown by such photon energy at the absorption edge is called X-ray absorption near edge structure (XANES) in XAFS, and an X-ray absorption spectrum of the fine structure is called a XANES spectrum. In XAFS measurement by a fluorescent X-ray yield method, such a XANES spectrum at the absorption edge of the Ni atom can be selectively measured.

(Radial Distribution Function around Ni Atom)

The embodiment of the invention extracts an EXAFS oscillating function $\chi(k)$ (EXAFS: Extended X-ray Absorption Fine Structure) from the obtained XANES measurement data (spectrum), then performs Fourier transformation to the function with adding weight of $k^3$, so that the radial distribution function (RDF) around the Ni atom is obtained.

(First Peak Position)

The embodiment of the invention selects a first peak position indicating an atomic distance between a Ni atom in Cu and an atom nearest to the Ni atom in the radial distribution function around a Ni atom according to the XAFS analysis method. Then, in the light of improving the stress relaxation property of the Cu—Ni—Sn—P alloy, it specifies the first peak position to be within a range of 2.16 to 2.35 Å.

Figure 1:
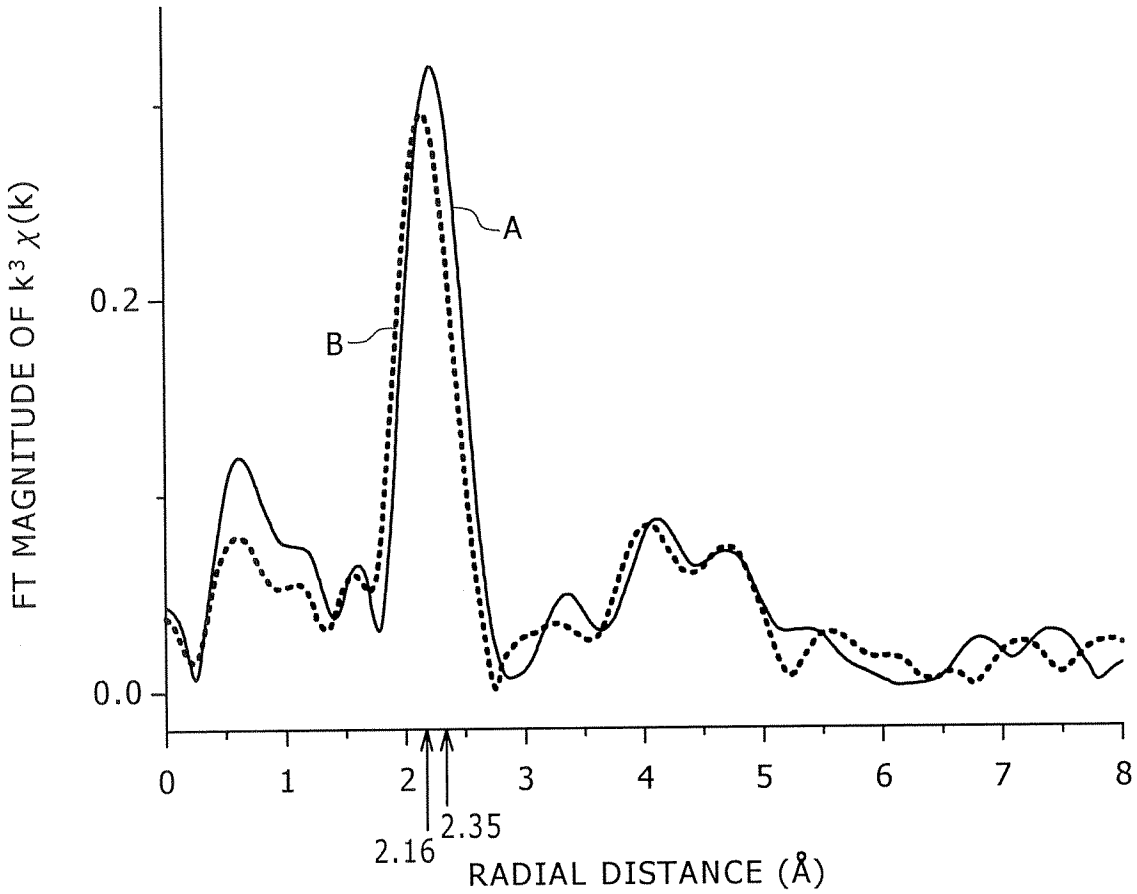
FIG. 1 is an explanatory view showing a radial distribution function around a Ni atom measured by the XAFS analysis method of a copper alloy.

FIG. 1 shows a radial distribution function around a Ni atom of a Cu—Ni—Sn—P alloy, which was measured according to the XAFS analysis method. In FIG. 1, a solid line A is the measured radial distribution function around the Ni atom of an inventive example (inventive example 1 in Table 2 in an examples described later), and a dot line B is that of a comparative example (comparative example 25 in Table 2 in the examples described later).

In the radial distribution functions around the Ni atom, a vertical axis is intensity of an oscillating function added with the weight of $k^3$ (FT Magnitude): $\chi(k)$, and a horizontal axis is an atomic distance to the Ni atom: A. In the radial distribution functions around the Ni atom, functions commonly showing maximum peaks (waveforms indicated by A and B) are the first peaks. A peak (top) position in the first peak is the first peak position (horizontal axis: the atomic distance between the Ni atom and the nearest atom).

In comparison between the inventive example A and the comparative example B in FIG. 1, the radial distribution function around the Ni element of the inventive example A is slightly shifted from right to left in FIG. 1 compared with that of the comparative example B.

In the embodiment of the invention, the slight shift is important, that is, the slight shift from right to left in FIG. 1 shows that in the Cu—Ni—Sn—P alloy, the distance (atomic distance) between the Ni atom in Cu and the atom such as Cu atom around the Ni atom is larger. That is, the inventive example A is larger in atomic distance from the Ni atom compared with the comparative example B. Therefore, the inventive example A is significantly excellent in stress relaxation property compared with the comparative example B. In other words, it is important that the slight shift from right to left of the radial distribution function around the Ni atom in FIG. 1 presents a significant difference in the stress relaxation property of the Cu—Ni—Sn—P alloy, even if a level of the shift is slight as an absolute level.

As an index having the smallest error in quantifying or specifying the shift from right to left in the light of the stress relaxation property, the embodiment of the invention selects a first peak position indicating the maximum peak in the radial distribution function around the Ni atom.

The first peak position in the inventive example A is 2.23 Å, which is within a range of 2.16 to 2.35 Å. On the other hand, the first peak position in the comparative example B is 2.14 Å, which is in a smaller side with respect to the range of 2.16 to 2.35 Å.

Therefore, as critically supporting meanings of lower and upper limit values in a more detailed manner in the examples described later, when the first peak position is less than 2.16 Å, the distance between the Ni atom in Cu and the atom such as Cu atom around the Ni atom is decreased, consequently the stress relaxation property of the Cu—Ni—Sn—P alloy is reduced. On the other hand, it is difficult in a manufacturing method that the first peak position is made to be more than 2.35 Å, and even if it is made to be more than 2.35 Å, the stress relaxation property of the Cu—Ni—Sn—P alloy is rather reduced. Therefore, the first peak position in the radial distribution function around the Ni atom is specified to be within a range of 2.16 to 2.35 Å.

(Experimental and Analytical Methods of XAFS Analysis)

Measurement of the radial distribution functions around the Ni atom of the Cu—Ni—Sn—P alloy was performed according to a transmission method using XAFS experimental apparatus of SUNBEAM BL16B2 of Industrial Consortium of the large synchrotron radiation facility Spring-8 of Japan Synchrotron Radiation Research Institute. A Si (111) crystal was used for a 2-crystal spectroscope, and measurement of K absorption edge of Ni was performed at normal temperature, so that the radial distribution function (RDF) around the Ni atom was obtained. Obtained data (spectra) were analyzed using the XAFS analysis software "WinXAS3.1" produced by Thorsten Ressler of the University of California.

(Composition of Copper Alloy)

Next, a composition of the copper alloy of the embodiment of the invention is described below. As described before, in the embodiment of the invention, the composition of the copper alloy is assumed to be a composition of the Cu—Ni—Sn—P alloy in which the ingot casting using the shaft-furnace can be carried out, so that significant reduction in cost can be achieved due to high productivity.

The copper alloy essentially contains 0.1 to 3.0% of Ni, 0.1 to 3.0% of Sn, and 0.01 to 0.3% of P respectively, and includes copper and inevitable impurities as the remainder in order to have an excellent stress relaxation property in the direction perpendicular to the rolling direction, which is required for the connection parts such as automotive terminals and connectors, and in addition, have excellent bending property, conductivity and strength. Any percent representation of contents of respective elements is mass percent. Hereinafter, for each of alloy elements of the copper alloy, reasons for adding or controlling the element are described.

(Ni)

Ni is an element necessary for improving the strength or the stress relaxation property by forming fine precipitates with P. In a content of less than 0.1%, the amount of fine Ni compounds in a size of 0.1 μm or less is insufficient even if the optimum manufacturing method of the embodiment of the invention is used. Therefore, a content of 0.1% or more is necessary to effectively bring out effects of Ni.

However, when Ni is excessively contained beyond 3.0%, compounds such as oxides, crystallized substances, and precipitates of Ni are coarsened, or coarse Ni compounds are increased, consequently reducing the strength and the stress relaxation property, and in addition, bendability is reduced. Therefore, the content of Ni is specified within a range of 0.1 to 3.0%. Preferably, it is within a range of 0.3 to 2.0%.

(Sn)

Sn is dissolved in the copper alloy and thus improves strength. In a Sn content of less than 0.1%, the strength is reduced. On the other hand, when it exceeds 3.0%, conductivity is decreased, consequently 30% IACS cannot be achieved. Therefore, the content of Sn is specified within a range of 0.1 to 3.0%. Preferably, it is within a range of 0.3 to 2.0%.

(P)

P is an element necessary for improving the strength or the stress relaxation property by forming fine precipitates with Ni. In a content of less than 0.01%, since the amount of P-based, fine precipitate particles is insufficient, a content of 0.01% or more is necessary. In particular, to stably obtain the excellent stress relaxation property in the direction perpendicular to the rolling direction, P of 0.04% or more is preferably contained. However, when it is excessively contained beyond 0.3%, precipitated particles of Ni—P intermetallic compounds are coarsened, consequently conductivity, bendability and hot workability are reduced in addition to the strength and the stress relaxation property. Therefore, the content of P is specified within a range of 0.01 to 0.3%, and preferably it is within a range of 0.04 to 0.2%.

(Fe, Zn, Mn, Si, Mg)

Fe, Zn, Mn, Si and Mg are easily mixed in from fusion materials such as scrap. The elements generally reduce conductivity while having certain effects respectively if contained. Moreover, when contents of them are increased, the ingot casting using the shaft-furnace becomes difficult. Therefore, in the case of obtaining conductivity of 30% IACS or more, 0.5% or less of Fe, 1% or less of Zn, 0.1% or less of Mn, 0.1% or less of Si, and 0.3% or less of Mg are specified respectively. In other words, the embodiment of the invention allows containing the elements in the amount of these upper limit values or less.

Fe increases recrystallization temperature of the copper alloy and thus refines crystal grain size. However, when a content of Fe exceeds 0.5%, conductivity is decreased, consequently 30% IACS cannot be achieved. Preferably, the content is specified to be 0.3% or less.

Zn prevents separation of tin plating. However, when a content of Zn exceeds 1%, conductivity is decreased, consequently 30% IACS cannot be achieved. When ingot casting is performed using the shaft-furnace, the content is desirably 0.05% or less. In a temperature range (about 150 to 180° C.) where the alloy is used for automotive terminals, Zn exhibits an effect that it can prevent separation of tin plating even in a content of 0.05% or less.

Mn and Si have an effect as a deoxidizer. However, when a content of Mn or Si exceeds 0.1%, conductivity is decreased, consequently 30% IACS cannot be achieved. When ingot casting is performed using the shaft furnace, it is desirably specified that Mn is 0.001% or less, and Si is 0.002% or less, respectively.

Mg functions to improve the stress relaxation property. However, when a content of Mg exceeds 0.3%, conductivity is decreased, consequently 30% IACS cannot be achieved. When ingot casting is performed using the shaft furnace, the content is desirably 0.001% or less.

(Ca, Zr, Ag, Cr, Cd, Be, Ti, Co, Au, Pt)

The copper alloy of the embodiment of the invention allows to further contain a total content of 1.0% or less of elements Ca, Zr, Ag, Cr, Cd, Be, Ti, Co, Au and Pt. These elements function to prevent coarsening of crystal grains. However, when the total content of the elements exceeds 1.0%, conductivity is decreased, and consequently 30% IACS cannot be achieved. In addition, the ingot casting using the shaft furnace becomes difficult.

In addition, Hf, Th, Li, Na, K, Sr, Pd, W, S, C, Nb, Al, V, Y, Me, Pb, In, Ga, Ge, As, Sb, Bi, Te, B and mish metals are impurities, of which the total content is limited to 0.1% or less.

(Method of Manufacturing Copper Alloy)

Next, a method of manufacturing the copper alloy of the embodiment of the invention is described below. The copper alloy of the embodiment of the invention can be manufactured in steps according to a common procedure. That is, casting of a molten copper alloy having a controlled composition, facing of a casting ingot, soaking, and hot rolling are performed, and then cold rolling and annealing are repeated, so that a final (product) sheet is obtained.

First, fusion and casting can be performed in a typical method such as continuous casting or semi-continuous casting. Hot rolling can be performed according to a common procedure, and it is specified in the hot rolling that entry-side temperature is about 600 to 1000° C., and finish temperature is about 600 to 850° C. After the hot rolling, water cooling or natural cooling is performed.

After that, cold rolling and annealing are performed to form a copper alloy sheet having a thickness as a product sheet. The annealing and the cold rolling may be repeated several times depending on final (product) thickness. In cold rough rolling, draft is selected such that draft of 30 to 70% is obtained in final cold rolling. Intermediate recrystallization annealing can be appropriately interposed during the cold rough rolling.

(Draft in Final Cold Rolling)

The draft in the final cold rolling affects the first peak position (atomic distance between the Ni atom and the nearest atom) in the radial distribution function around the Ni atom. When the draft in the final cold rolling is smaller than 30%, driving force of moving atoms such as Cu atoms around the Ni atom into stable arrangement becomes insufficient in subsequent annealing. Therefore, the first peak position tends to be less than 2.16 Å, consequently the stress relaxation property of the Cu—Ni—Sn—P alloy is reduced. Moreover, since a level of increase in strength due to processing is small, strength is reduced in the final sheet. On the other hand, when the draft in the final cold rolling is more than 80%, strain accumulation is excessively increased, resulting in reduction in bendability.

(Low-Temperature Annealing)

In low-temperature annealing after the final cold rolling, a cooling condition or a heating condition also significantly affects the first peak position (atomic distance between the Ni atom and the nearest atom) in the radial distribution function around the Ni atom. The low-temperature annealing can be performed in either of a continuous annealing furnace (at substance temperature of 300 to 500° C. for about 10 to 60 sec) and a batch annealing furnace (at substance temperature of 200 to 400° C. for about 1 to 20 hours).

However, in order to keep a condition of atoms such as Cu atoms around the Ni atom, which have been moved into the stable arrangement in the heating step to an isothermal holding step, cooling rate after the low-temperature annealing is specified to be 100° C./sec or more commonly in the continuous annealing furnace and the batch annealing furnace. When the cooling rate is decreased, the first peak position tends to be less than 2.16 Å, consequently the stress relaxation properties of the Cu—Ni—Sn—P alloy is reduced.

Here, only in the continuous annealing furnace, even in the low-temperature annealing, when holding time in a high-temperature range is increased, recovery and recrystallization occur, consequently the first peak position in the radial distribution function around the Ni atom deviates from the range specified by the embodiment of the invention, and in addition, strength is reduced. Therefore, in the continuous annealing furnace, the heating rate is preferably controlled to be 50° C./sec or more.

EXAMPLES

Hereinafter, examples of the embodiment of the invention are described. Various thin sheets of copper alloy of Cu—Ni—Sn—P alloys having different first peak positions in the radial distribution functions around the Ni atom, and different atomic distances between the Ni atom and the nearest atom were manufactured, and properties such as strength, conductivity, and stress relaxation property were evaluated.

Specifically, copper alloys having respective chemical compositions shown in Table 1 were fused in a coreless furnace respectively, then ingoted by the semi-continuous casting method, consequently casting ingots 70 mm thick by 200 mm wide by 500 mm long were obtained (cooling solidification speed during casting was 1 to 2° C./sec). The casting ingots were rolled commonly in the following condition to manufacture copper alloy thin sheets.

Surfaces of the respective casting ingots were faced, then the ingots were heated at extraction temperature of 960° C. in a heating furnace, and then subjected to hot rolling within a range of hot-rolling finish temperature of 700 to 750° C. to be formed into sheets 16 mm in thickness, and then quenched into water from a temperature of 650° C. or more. After oxidized scale was removed, the sheets were subjected to cold rolling, continuous casting, final cold rolling, and annealing in order, so that copper alloy thin-sheets were manufactured. That is, sheets after primary cold rolling (rough cold rolling and cogging cold rolling) were faced, then subjected to continuous annealing of holding the sheets at a substance temperature of 660° C. for 20 sec, and then the final cold rolling and the subsequent low-temperature annealing were performed in a condition shown in Table 2, so that the copper alloy thin sheets 0.25 mm in thickness were obtained.

At that time, as shown in Table 2, the draft in the final cold rolling, and a cooling condition or a heating condition of the low-temperature annealing by the continuous annealing subsequent to the cold rolling were changed, so that the first peak position (atomic distance between the Ni atom and the nearest atom) in the radial distribution function around the Ni atom was changed.

In each of examples, specimens were cut out from each of the obtained copper alloy sheets, and a tensile test, measurement of conductivity, measurement of a stress relaxation ratio, and a bending test were performed. Results of them are also shown in Table 2.

(Tensile Test)

A test piece was sampled from the copper alloy thin-sheet, and a tensile test piece of JIS 5 was prepared by machining such that a longitudinal direction of the test piece was perpendicular to a rolling direction of a sheet material. Then, mechanical properties were measured using the 5822 universal testing machine manufactured by INSTRON Corp. at a condition of room temperature, test speed of 10.0 mm/min, and GL of 50 mm. Yield strength is tensile strength corresponding to permanent elongation of 0.2%.

(Measurement of Conductivity)

Specimens were sampled from the copper alloy thin sheets, and conductivity was measured. Regarding the conductivity of the copper alloy sheet specimens, reed-shaped test pieces 10 mm in width and 300 mm in length were machined by milling, then electric resistance was measured using a double-bridge resistance meter according to the Measuring Method for Conductivity of Non-ferrous Materials defined in JIS-H0505, and then conductivity was calculated using the averaged cross section method.

(Stress Relaxation Property)

Figure 3A:
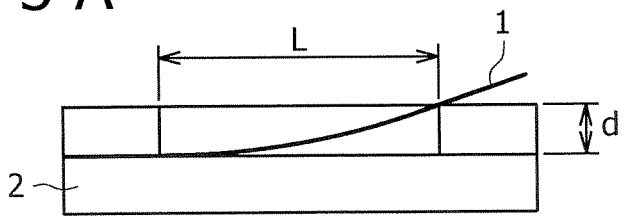
FIGS. 3A to 3B are cross sectional views illustrating a stress-relaxation resistance test of a copper alloy sheet.
Figure 3B:
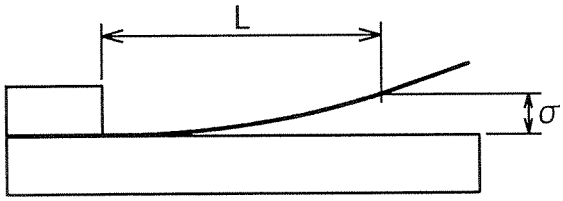
Figure 4A:
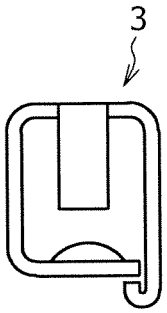
Figure 4B:
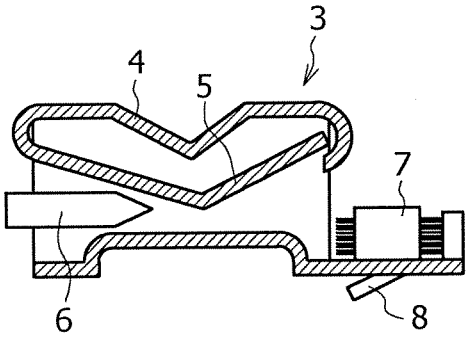

Stress relaxation ratios in a direction perpendicular to a rolling direction of the copper alloy thin sheets were measured, so that the stress relaxation properties in the direction were evaluated. Specifically, test pieces were sampled from the copper alloy thin sheets, and subjected to measurement using a cantilever method shown in FIG. 3. A reed-shape test piece 1, 10 mm in width (test piece having a longitudinal direction perpendicular to the rolling direction of a sheet material), was cut out, and fixed to a rigid-body test stage 2 at one end, and as shown in FIG. 3A, a deflection level in a magnitude of d (=10 mm) is given to a portion of span length L of the test piece 1. At that time, L is determined such that surface stress corresponding to 80% of yield strength of a material is loaded to the material. Such a test piece was held for 30 hours in an oven at 180° C. and then removed, and as shown in FIG. 3B, permanent strain δ remained after the deflection level d was removed, was measured, and the stress relaxation ratios (RS) were calculated by $RS=(\delta/d)\times 100$. When calculation is made using the Larson Miller parameter, holding at 180° C. for 30 hours is approximately corresponding to holding at 150° C. for 1000 hours.

(Evaluation Test of Bendability)

Bending tests of the copper alloy sheet specimens were performed according to the technical standard of Japan Copper and Brass Association. A sheet material was cut into specimens 10 mm in width and 30 mm in length, and Good Way (a bending axis is perpendicular to the rolling direction) bending was performed with a bending radius of 0.5 mm, and presence of cracks in a bending portion was visually observed by a light microscope with a magnification factor of x50. It was evaluated that a specimen without cracks was ○ (good), and a specimen with cracks was x (bad).

As clear from Table 2, inventive examples 1 to 15 as copper alloys (alloy numbers 1 to 12) within a composition of the embodiment of the invention in Table 1 are manufactured within preferable conditions of the draft in the final cold rolling, and the cooling condition or the heating condition of the low-temperature annealing by the continuous annealing after the cold rolling. Other manufacturing conditions are also appropriate.

Therefore, in the inventive examples 1 to 15 in Table 2, the first peak positions are within the range of 2.16 to 2.35 Å in the radial distribution function around the Ni atom according to the XAFS analysis method.

As a result, in the inventive examples 1 to 15, excellent stress relaxation property having the stress relaxation ratio of 15% or less can be achieved in the direction perpendicular to the rolling direction. Moreover, they have excellent properties for terminals and connectors, such as excellent bending property and high strength (yield strength of 480 MPa or more).

Even in the inventive examples 1 to 15 in Table 2, inventive examples 9 to 15 (alloy numbers 6 to 12 in Table 1), in which the amounts of other elements exceed the preferable upper limit, have low conductivity compared with inventive examples 1 to 8.

In the inventive examples 9 to 13, contents of Fe, Zn, Mn, Si and Mg are high beyond the preferable upper limit respectively, as the alloy numbers 6 to 10 in Table 1.

In the inventive example 14, a total content of elements of Ca, Zr, Ag, Cr, Cd, Be, Ti, Co, Au and Pt is high beyond the preferable upper limit of 1.0 percent by mass, as the alloy number 11 in Table 1.

In the inventive example 15, a total content of elements of Hf, Th, Li, Na, K, Sr, Pd, W, S, C, Nb, Al, V, Y, Mo, Pb, In, Ga, Ge, As, Sb, Bi, Te, B and mish metals is high beyond the preferable upper limit of 0.1 percent by mass, as the alloy number 12 in Table 1.

On the contrary, in comparative examples 22 to 25 in Table 2, manufacturing conditions deviate from the preferable range respectively, even though they are copper alloys (alloy number 1) having compositions within the composition of the embodiment of the invention in Table 1. The comparative example 22 has excessively small draft in the final cold rolling. The comparative example 23 has an excessively slow (excessively small) average cooling rate in the low-temperature annealing by the continuous annealing after the final cold rolling. The comparative example 24 has an excessively slow (excessively small) average heating rate in the low-temperature annealing. In the comparative example 25, the low-temperature annealing after the final cold rolling is omitted.

Therefore, in the comparative examples 22 to 25 in Table 2, the first peak positions deviate from the range of 2.16 to 2.35 Å in the radial distribution function around the Ni atom according to the XAFS analysis method. As a result, the comparative examples 22 to 25 have extremely low stress relaxation properties in the direction perpendicular to the rolling direction compared with the inventive examples.

Comparative examples 16 to 21 in Table 2 use copper alloys having compositions without the composition of the embodiment of the invention of the alloy numbers of 13 to 18 in Table 1. Therefore, while manufacturing conditions are within the preferable range, they are significantly inferior in one of the first peak position in the radial distribution function around the Ni atom according to the XAFS analysis method, stress relaxation property, bending property, conductivity, and strength, compared with the inventive examples.

The copper alloy of the comparative example 16 has a Ni content that is out of the lower limit (alloy number 13 in Table 1). Therefore, the strength or the stress relaxation property is low.

The copper alloy of the comparative example 17 has a Ni content that is out of the upper limit (alloy number 14 in Table 1). Therefore, the strength, conductivity, stress relaxation property, or bendability is low.

The copper alloy of the comparative example 18 has a Sn content that is out of the lower limit (alloy number 15 in Table 1). Therefore, the strength is low.

The copper alloy of the comparative example 19 has a Sn content that is out of the upper limit (alloy number 16 in Table 1). Therefore, the conductivity is low.

The copper alloy of the comparative example 20 has a P content that is out of the lower limit (alloy number 17 in Table 1). Therefore, the strength or the stress relaxation property is low.

The copper alloy of the comparative example 21 has a P content that is out of the upper limit (alloy number 18 in Table 1). Therefore, the strength, conductivity, stress relaxation property, or bendability is low.

From the above results, the significance of the composition and structure for having an excellent stress relaxation property or excellent bendability in the direction perpendicular to the rolling direction, in addition to high strength and high conductivity, and furthermore the significance of the preferable manufacturing condition for obtaining the structure are supported.

TABLE 1

| Section | No. | Chemical composition of copper alloy sheets (the remainder; Cu) | | | | | | | | | |
|---|---|---|---|---|---|---|---|---|---|---|---|
| | | Ni | Sn | P | Fe | Zn | Mn | Si | Mg | Other element group A | Other element group B |
| Inventive examples | 1 | 0.75 | 1.15 | 0.07 | 0.02 | 0.02 | 0.01 | 0.01 | 0.01 | — | — |
| | 2 | 0.60 | 0.55 | 0.05 | 0.02 | 0.03 | 0.02 | 0.01 | 0.02 | — | — |
| | 3 | 1.05 | 0.75 | 0.06 | 0.01 | 0.01 | 0.02 | 0.02 | 0.01 | — | — |
| | 4 | 0.30 | 1.10 | 0.02 | 0.02 | 0.02 | 0.01 | 0.01 | 0.02 | — | — |
| | 5 | 2.35 | 0.70 | 0.23 | 0.01 | 0.02 | 0.02 | 0.01 | 0.01 | — | — |
| | 6 | 0.75 | 1.15 | 0.07 | 0.70 | 0.03 | 0.01 | 0.01 | 0.01 | — | — |
| | 7 | 0.75 | 1.15 | 0.07 | 0.03 | 1.20 | 0.01 | 0.02 | 0.02 | — | — |
| | 8 | 0.75 | 1.15 | 0.07 | 0.03 | 0.02 | 0.12 | 0.01 | 0.01 | — | — |
| | 9 | 0.75 | 1.15 | 0.07 | 0.01 | 0.03 | 0.02 | 0.12 | 0.02 | — | — |
| | 10 | 0.75 | 1.15 | 0.07 | 0.01 | 0.02 | 0.01 | 0.02 | 0.35 | — | — |
| | 11 | 0.75 | 1.15 | 0.07 | 0.02 | 0.02 | 0.01 | 0.02 | 0.01 | 1.20 | — |
| | 12 | 0.75 | 1.15 | 0.07 | 0.03 | 0.03 | 0.02 | 0.01 | 0.01 | — | 0.15 |
| Comparative examples | 13 | 0.05 | 1.15 | 0.07 | 0.02 | 0.02 | 0.01 | 0.01 | 0.02 | — | |
| | 14 | 3.25 | 1.15 | 0.07 | 0.02 | 0.03 | 0.02 | 0.01 | 0.01 | — | — |
| | 15 | 0.75 | 0.05 | 0.07 | 0.02 | 0.02 | 0.01 | 0.01 | 0.01 | — | — |
| | 16 | 0.75 | 3.40 | 0.07 | 0.01 | 0.02 | 0.01 | 0.02 | 0.01 | — | — |
| | 17 | 0.75 | 1.15 | 0.004 | 0.03 | 0.02 | 0.02 | 0.01 | 0.02 | — | — |
| | 18 | 0.75 | 1.15 | 0.35 | 0.02 | 0.03 | 0.01 | 0.02 | 0.01 | — | — |

—; below detection threshold other element group A: total content of Ca, Zr, Ag, Cr, Cd, Be, Ti, Co, Au and Pt other element group B: total content of Hf, Th, Li, Na, K, Sr, Pd, W, S, C, Nb, Al, V, Y, Mo, Pb, In, Ga, Ge, As, Sb, Bi, Te, B and mish metals

TABLE 2

| Section | No. | Alloy | | Low-temperature annealing after final cold rolling | | | Structure of copper alloy sheets First peak position in |
|---|---|---|---|---|---|---|---|
| | | number in Table 1 | Draft in final cold rolling (%) | Heating temperature (° C.) | Heating rate (° C./sec) | Cooling rate (° C./sec) | radial distribution function around Ni atom in [XAFS] (Å) |
| Inventive examples | 1 | 1 | 50 | 350 | 100 | 200 | 2.23 |
| | 2 | 1 | 60 | 350 | 75 | 150 | 2.21 |
| | 3 | 1 | 50 | 250 | 0.1 | 200 | 2.18 |
| | 4 | 1 | 40 | 450 | 100 | 150 | 2.19 |
| | 5 | 2 | 60 | 300 | 100 | 250 | 2.24 |
| | 6 | 3 | 45 | 350 | 100 | 200 | 2.21 |
| | 7 | 4 | 70 | 250 | 0.1 | 150 | 2.17 |
| | 8 | 5 | 35 | 450 | 75 | 200 | 2.17 |
| | 9 | 6 | 55 | 450 | 100 | 200 | 2.29 |
| | 10 | 7 | 50 | 350 | 125 | 200 | 2.30 |
| | 11 | 8 | 50 | 400 | 125 | 150 | 2.26 |
| | 12 | 9 | 50 | 350 | 100 | 200 | 2.26 |
| | 13 | 10 | 45 | 250 | 0.1 | 200 | 2.33 |
| | 14 | 11 | 40 | 400 | 125 | 150 | 2.26 |
| | 15 | 12 | 60 | 350 | 100 | 200 | 2.29 |
| Comparative examples | 16 | 13 | 50 | 350 | 100 | 200 | 2.20 |
| | 17 | 14 | 50 | 350 | 100 | 150 | 2.22 |
| | 18 | 15 | 50 | 350 | 75 | 200 | 2.21 |
| | 19 | 16 | 50 | 400 | 100 | 150 | 2.26 |
| | 20 | 17 | 50 | 350 | 100 | 200 | 2.23 |
| | 21 | 18 | 50 | 350 | 100 | 150 | 2.22 |
| | 22 | 1 | 20 | 350 | 100 | 150 | 2.15 |
| | 23 | 1 | 50 | 350 | 100 | 25 | 2.14 |
| | 24 | 1 | 50 | 350 | 20 | 150 | 2.14 |
| | 25 | 1 | 60 | — | — | — | 2.14 |

| Section | No. | Propertied of copper alloy sheets | | | | |
|---|---|---|---|---|---|---|
| | | Tensile strength (MPa) | 0.2% Yield strength(MPa) | Conductivity (% IACS) | Stress relaxation ratio(%) | Bendability |
| Inventive examples | 1 | 540 | 525 | 33 | 11 | ○ |
| | 2 | 535 | 520 | 34 | 12 | ○ |
| | 3 | 530 | 510 | 38 | 14 | ○ |
| | 4 | 535 | 515 | 35 | 13 | ○ |
| | 5 | 530 | 510 | 41 | 11 | ○ |
| | 6 | 535 | 515 | 40 | 13 | ○ |
| | 7 | 500 | 480 | 50 | 15 | ○ |
| | 8 | 520 | 500 | 31 | 15 | ○ |

TABLE 2-continued

| | | | | | | |
|---|---|---|---|---|---|---|
| | 9 | 535 | 520 | 28 | 11 | ○ |
| | 10 | 540 | 525 | 25 | 11 | ○ |
| | 11 | 545 | 525 | 26 | 10 | ○ |
| | 12 | 540 | 520 | 27 | 10 | ○ |
| | 13 | 550 | 530 | 24 | 12 | ○ |
| | 14 | 555 | 535 | 25 | 10 | ○ |
| | 15 | 540 | 520 | 28 | 11 | ○ |
| Comparative examples | 16 | 465 | 445 | 41 | 21 | ○ |
| | 17 | 470 | 455 | 27 | 19 | X |
| | 18 | 440 | 425 | 42 | 13 | ○ |
| | 19 | 555 | 535 | 22 | 11 | ○ |
| | 20 | 455 | 440 | 38 | 19 | ○ |
| | 21 | 465 | 450 | 25 | 20 | X |
| | 22 | 485 | 465 | 34 | 20 | X |
| | 23 | 505 | 490 | 36 | 24 | X |
| | 24 | 495 | 475 | 35 | 25 | X |
| | 25 | 560 | 540 | 32 | 30 | X |

As described hereinbefore, according to the invention, the Cu—Ni—Sn—P alloy can be provided, which is excellent in stress relaxation property in the direction perpendicular to the rolling direction, and has high strength, high conductivity, and excellent bendability. As a result, the alloy can be applied to use requiring excellent stress relaxation property in the direction perpendicular to the rolling direction particularly for the connection parts such as automotive terminals and connectors.

What is claimed is:

1. A copper alloy having excellent stress relaxation properties comprising:

0.1 to 3.0% of Ni, 0.1 to 3.0% of Sn, and 0.01 to 0.3% of P, in mass percent respectively, and the remainder being copper and inevitable impurities, wherein the Ni/P ratio in the copper alloy is from 10.2 to 17.5;

wherein in a radial distribution function around a Ni atom according to a XAFS analysis method, a first peak position is within a range of 2.16 to 2.35 Å, the position indicating a distance between a Ni atom in Cu and an atom nearest to the Ni atom;

wherein said copper alloy has a conductivity of 24 to 41% IACS;

wherein said excellent stress relaxation properties are defined as having a stress relaxation ratio of 10 to 15% in the direction perpendicular to the direction the copper alloy is rolled; and wherein said copper alloy is made by a method which comprises:

(1) final cold rolling wherein the range of the draft in final cold rolling is 30 to 70%; and (2) low-temperature annealing in a continuous annealing furnace at a substance temperature of 300 to 500° C. after final cold rolling, with a heating rate of low-temperature annealing in the continuous annealing furnace of 50° C./sec or more and a cooling rate after low-temperature annealing in the continuous annealing furnace of 100° C./sec or more.

2. The copper alloy having excellent stress relaxation properties according to claim 1, wherein the copper alloy further comprises 0.5% or less of Fe, 1% or less of Zn, 0.1% or less of Mn, 0.1% or less of Si, and 0.3% or less of Mg in mass percent.

3. The copper alloy having excellent stress relaxation properties according to claim 1, wherein the copper alloy further comprises at least one element selected from the group consisting of Ca, Zr, Ag, Cr, Cd, Be, Ti, Co, Au and Pt, and a total content of the element is 1.0% or less in mass percent.

4. The copper alloy having excellent stress relaxation properties according to claim 2, wherein the copper alloy further comprises at least one element selected from the group consisting of Ca, Zr, Ag, Cr, Cd, Be, Ti, Co, Au and Pt, and a total content of the element is 1.0% or less in mass percent.

5. The copper alloy having excellent stress relaxation properties according to claim 1, wherein the copper alloy further comprises at least one element selected from the group consisting of Hf, Th, Li, Na, K, Sr, Pd, W, S, C, Nb, Al, V, Y, Mo, Pb, In, Ga, Ge, As, Sb, Bi, Te, B and mish metals, and a total content of the elements is 0.1% or less in mass percent.

6. The copper alloy having excellent stress relaxation properties according to claim 2, wherein the copper alloy further comprises at least one element selected from the group consisting of Hf, Th, Li, Na, K, Sr, Pd, W, S, C, Nb, Al, V, Y, Mo, Pb, In, Ga, Ge, As, Sb, Bi, Te, B and mish metals, and a total content of the elements is 0.1% or less in mass percent.

7. The copper alloy having excellent stress relaxation properties according to claim 3, wherein the copper alloy further comprises at least one element selected from the group consisting of Hf, Th, Li, Na, K, Sr, Pd, W, S, C, Nb, Al, V, Y, Mo, Pb, In, Ga, Ge, As, Sb, Bi, Te, B and mish metals, and a total content of the elements is 0.1% or less in mass percent.

8. The copper alloy having excellent stress relaxation properties according to claim 1, wherein the copper alloy has a conductivity of 31 to 41% IACS.

9. The copper alloy having excellent stress relaxation properties according to claim 2, wherein the copper alloy has a conductivity of 31 to 41% IACS.

10. The copper alloy having excellent stress relaxation properties according to claim 3, wherein the copper alloy has a conductivity of 31 to 41% IACS.

11. The copper alloy having excellent stress relaxation properties according to claim 1, wherein the copper alloy has a yield strength of about 480 MPa or more.

12. The copper alloy having excellent stress relaxation properties according to claim 2, wherein the copper alloy has a yield strength of about 480 MPa or more.

13. The copper alloy having excellent stress relaxation properties according to claim 3, wherein the copper alloy has a yield strength of about 480 MPa or more.

14. The copper alloy having excellent stress relaxation properties according to claim 1, wherein the copper alloy comprises 0.3 to 2.0% Ni.

15. The copper alloy having excellent stress relaxation properties according to claim 1, wherein the copper alloy comprises 0.3 to 2.0% Sn.

16. The copper alloy having excellent stress relaxation properties according to claim 1, wherein the copper alloy comprises 0.04 to 0.2% P.

17. The copper alloy having excellent stress relaxation properties according to claim 1, wherein the copper alloy comprises 0.3 to 2.0% Ni, 0.3 to 2.0% Sn, and 0.04 to 0.2% P.

18. A copper alloy having excellent stress relaxation properties comprising:

0.1 to 3.0% of Ni, 0.1 to 3.0% of Sn, and 0.01 to 0.3% of P, in mass percent respectively, and the remainder being copper and inevitable impurities, wherein the Ni/P ratio in the copper alloy is from 10.2 to 17.5;

wherein in a radial distribution function around a Ni atom according to a XAFS analysis method, a first peak position is within a range of 2.16 to 2.35 Å, the position indicating a distance between a Ni atom in Cu and an atom nearest to the Ni atom;

wherein said copper alloy has a conductivity of 24 to 41 MACS;

wherein said excellent stress relaxation properties are defined as having a stress relaxation ratio of 11 to 15% in the direction perpendicular to the direction the copper alloy is rolled; and wherein said copper alloy is made by a method which comprises:

(1) final cold rolling wherein the range of the draft in final cold rolling is 30 to 70%; and (2) low-temperature annealing in a continuous annealing furnace at a substance temperature of 300 to 500° C. after final cold rolling, with a heating rate of low-temperature annealing in the continuous annealing furnace of 50° C./sec or more and a cooling rate after low-temperature annealing in the continuous annealing furnace of 100° C./sec or more.

* * * * *